US007841133B2

(12) United States Patent
Augustyniak et al.

(10) Patent No.: US 7,841,133 B2
(45) Date of Patent: Nov. 30, 2010

(54) PASSAGE BARRIER

(75) Inventors: Matthias Augustyniak, Monchengladbach (DE); Dieter Schwald, Schopfheim (DE)

(73) Assignee: Scheidt & Bachmann GmbH (DE)

( * ) Notice: Subject to any disclaimer, the term of this patent is extended or adjusted under 35 U.S.C. 154(b) by 900 days.

(21) Appl. No.: 11/710,684

(22) Filed: Feb. 23, 2007

(65) Prior Publication Data

US 2007/0209280 A1 Sep. 13, 2007

(30) Foreign Application Priority Data

Feb. 23, 2006 (EP) ..... 06003695

(51) Int. Cl.
*E06B 11/08* (2006.01)

(52) U.S. Cl. ..... 49/42; 49/46; 49/334

(58) Field of Classification Search ..... 49/24, 49/42, 44, 46, 98, 104, 109, 136, 142, 163, 49/168, 324, 326, 327, 333, 334
See application file for complete search history.

(56) References Cited

U.S. PATENT DOCUMENTS

| | | | | | |
|---|---|---|---|---|---|
| 417,141 | A | * | 12/1889 | Brady | 49/46 |
| 972,505 | A | * | 10/1910 | Catton | 49/142 |
| 1,179,754 | A | * | 4/1916 | Potter | 256/1 |
| 1,531,107 | A | * | 3/1925 | Larson | 187/331 |
| 2,613,639 | A | * | 10/1952 | Christ | 119/426 |
| 3,886,684 | A | * | 6/1975 | Sheckells | 49/44 |
| 5,444,941 | A | * | 8/1995 | Gallenschutz | 49/42 |
| 5,711,111 | A | * | 1/1998 | Nyffenegger et al. | 49/42 |
| 5,718,089 | A | * | 2/1998 | Dakin | 52/204.1 |
| D539,921 | S | * | 4/2007 | Williman | D25/50 |

FOREIGN PATENT DOCUMENTS

| | | | |
|---|---|---|---|
| DE | 3138201 | A1 * | 4/1983 |
| EP | 1 475 509 | A1 | 8/2002 |
| GB | 2423327 | A * | 8/2006 |
| WO | WO 2005049948 | A1 * | 6/2005 |

OTHER PUBLICATIONS

Align definition, downloaded from http://www.thefreedictionary.com/align; The American Heritage® Dictionary of the English Language, Fourth Edition copyright © 2000 by Houghton Mifflin Company. Updated in 2009. Published by Houghton Mifflin Company. Definition provided in action mailed with this form.*

* cited by examiner

*Primary Examiner*—Katherine W Mitchell
*Assistant Examiner*—Michael J Keller
(74) *Attorney, Agent, or Firm*—Harness, Dickey & Pierce, P.L.C.

(57) ABSTRACT

A passage barrier (10) with two barrier elements (24, 26) and two mutually aligned shafts (16, 20) which are separate from each other and can be driven by separate motors (14, 22), whereby one barrier element (24, 26) is retained on each shaft (16, 20), and can be swivelled independent of the other barrier element (26, 24) by driving the corresponding shaft (16, 20).

12 Claims, 3 Drawing Sheets

PASSAGE BARRIER

BACKGROUND OF THE INVENTION

1. Technical Field

The present invention relates to passage barriers with automatically swivelling barrier elements.

2. Discussion

Passage barriers of the said kind are known in the most varied embodiments and serve to optionally permit or block the passage of a person or the passage of a vehicle. In a simple construction, they may be designed as a revolving door with two barrier elements arranged opposite each other and mutually aligned, each of which is firmly attached to a common shaft extending vertically between the barrier elements and which can be driven by a motor. By driving the shaft, both barrier elements can be swivelled together around the shaft. If the two barrier elements secure different passageways, it may be desirable to swivel the barrier elements independent of each other, for instance if one passageway should be opened, while the other should remain blocked. In order to enable separate swivelling of both barrier elements, two shafts may be provided each of which can be driven by a motor and on each of which one barrier element is retained. By driving the first shaft, one of the barrier elements, and by driving the second shaft, the other barrier element can be swivelled. Problematic with this solution, however, is the fact that it takes up a relatively large amount of space and material, which is explained in more detail in the following with reference to FIGS. 2, 3 and 4.

FIG. 2 is a schematic diagram and shows a known passage barrier 50 in a top view. The passage barrier 50 comprises two passageways 52 and 54, which are essentially defined by partition walls 56, 58, 60 and 62. For optional opening or blocking the passageways 52 and 54, barrier elements 64 and 66 are provided which may be designed for instance as doors or the like. For swivelling the barrier elements 64 and 66 in the direction of the arrows 68 and 70, they are firmly retained on one of two juxtaposed shafts 72, 74, whereby the shafts 72 and 74 can be driven by corresponding motors 76 and 78. Due to the fact that the arrangement comprising the barrier element 64, the shaft 72 and the motor 78 are juxtaposed, the passage barrier 50 shown in FIG. 2, however, takes up a lot of space, which is disadvantageous, in particular when only a small amount of space is available.

FIG. 3 is a schematic diagram showing another known passage barrier 80 in a top view. Similar to the passage barrier 50 shown in FIG. 2, passage barrier 80 has two passageways 82 and 84, which are essentially defined by partition walls 86 to 92. For optional opening or blocking the passageways 82 and 84, barrier elements 94 and 96 are provided, which can be swivelled in the direction of the arrows 106 and 108 around shafts 98 and 100, respectively, which can be driven by motors 102 and 104. In order to reduce the width of passage barrier 80 in comparison with passage barrier 50 shown in FIG. 2, the arrangement comprising the passage barrier 94, the shaft 98, and the motor 102, and the arrangement comprising the barrier element 96, the shaft 100, and the motor 104 are positioned one behind the other, so that the barrier elements 94 and 96 are arranged staggered in relation to one another. One disadvantage of this design is that due to the staggered barrier elements 94 and 96, the symmetric appearance of the passage barrier 80 is adversely affected. Another disadvantage occurs when several of the passage barriers 80 shown in FIG. 3 are arranged immediately juxtaposed, as is shown in FIG. 4.

FIG. 4 is a schematic diagram showing a passage barrier 110 in a top view. The passage barrier 110 comprises a multitude of similarly constructed units 112 marked by the dashed line in FIG. 3, consisting of the partition walls 88 and 90, the barrier elements 94 and 96, the shafts 98 and 100, and the motors 102 and 104, which are juxtaposed; in FIG. 4, however, only three of these units are shown. Other units 112 are intimated by the dots marked with the reference numeral 114. Two adjacent units 112 each form a passageway 116, which is optionally blocked or released by the barrier elements 94 and 96. An essential disadvantage of the shown passage barrier 110 is that due to the structurally alike units 112, barrier elements 94 and 96 pointing to each other are staggered in relation to each other, since each of the arrangement consisting of the barrier element 94, the shaft 98 and the motor 102, and the arrangement consisting of the barrier element 96, the shaft 100 and the motor 104 are provided one behind the other. Due to these barrier elements 94 and 96 which are staggered in relation to each other, a gap is created through which, even in blocked position of the barrier elements 94 and 96, a person can pass the passage barrier 110, which is intimated by the arrows 118.

It is the main objective of the present invention to create an improved passage barrier of the kind mentioned above.

The passage barrier according to the present invention comprises two barrier elements and two separate shafts which are mutually aligned and can be driven by separate motors. One barrier element, for instance with one or more fixed bearings, is retained on each shaft and can be swivelled independent of the other barrier element by driving the appropriate shaft. The shafts can have a profiled, for instance angular, cross-section or a profiled outside contour, respectively. Rotationally symmetric shafts are preferably used, since these facilitate the accommodation. The shafts are preferably hollow shafts, in which lines not visible from outside, in particular electric power and/or control lines, can be arranged.

The essential advantage of the passage barrier according to the invention is that a lot of space is saved due to the mutually aligned shafts. The passage barrier obtains a very compact and functional structure.

The mutually aligned shafts can be separated from each other by at least one bearing. The bearing is advantageous in that it imparts greater stability to the shafts.

Preferably, each barrier element is retained on one shaft by at least one fixed bearing and on the other shaft by at least one movable bearing. The respective fixed bearing serves to create a firm connection between the barrier element and the driving shaft, so that the barrier element follows the rotational motion of the shaft. The movable bearing serves to retain the barrier element also on the respective other shaft, which is not the driving shaft, whereby, however, the rotational motion of the other shaft is not transmitted to the respective barrier element. In this manner, an even more stable structure of the passage barrier is achieved.

The motors driving the shafts can be alternating current motors, whereby a gear may be provided between the motors and the respective shafts, as for instance a reduction gear, in order to reduce a high motor speed and to multiply a low driving torque of the motor. Preferably, however, direct current motors are used, since these have in particular a good transient behaviour and are very well controllable. In addition, direct current motors can be adjusted without any problem to the various power supply mains of different countries. Advantageously, a servo controller is assigned to each direct current motor, by which the motor speed can be controlled precisely. Also the torque, and therefore the power applied to the barrier element to be swivelled, can be adjusted precisely by means of the servo controller. Speed and torque used to swivel the barrier elements can correspondingly be adjusted as required. According to a preferred design of the passage barrier according to the invention, the latter comprises at least one partition wall which is provided between the barrier elements and defines passage areas. The at least one partition wall is advantageously firmly connected with the bearing and/or with at least one movable bearing, thereby stabilising the partition wall.

BRIEF DESCRIPTION OF THE DRAWINGS

In the following, the present invention is described on the basis of an exemplary embodiment with reference to the enclosed drawing. In this drawing.

DESCRIPTION OF THE PREFERRED EMBODIMENTS

Figure 1:
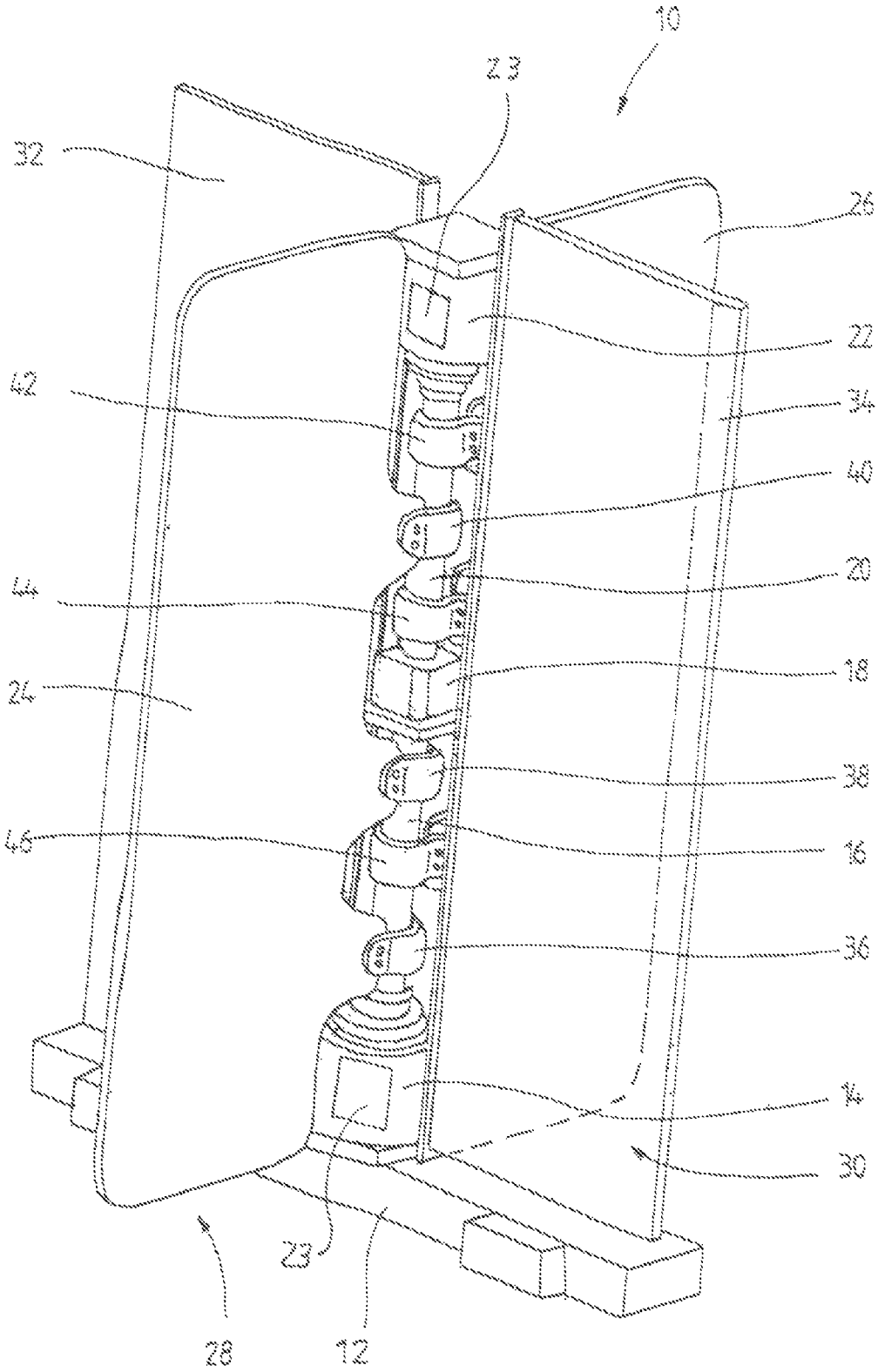
FIG. 1 is a perspective view of an embodiment of a passage barrier in accordance with the present invention.

In the drawing, identical reference numerals refer to similar components.

Figure 3:
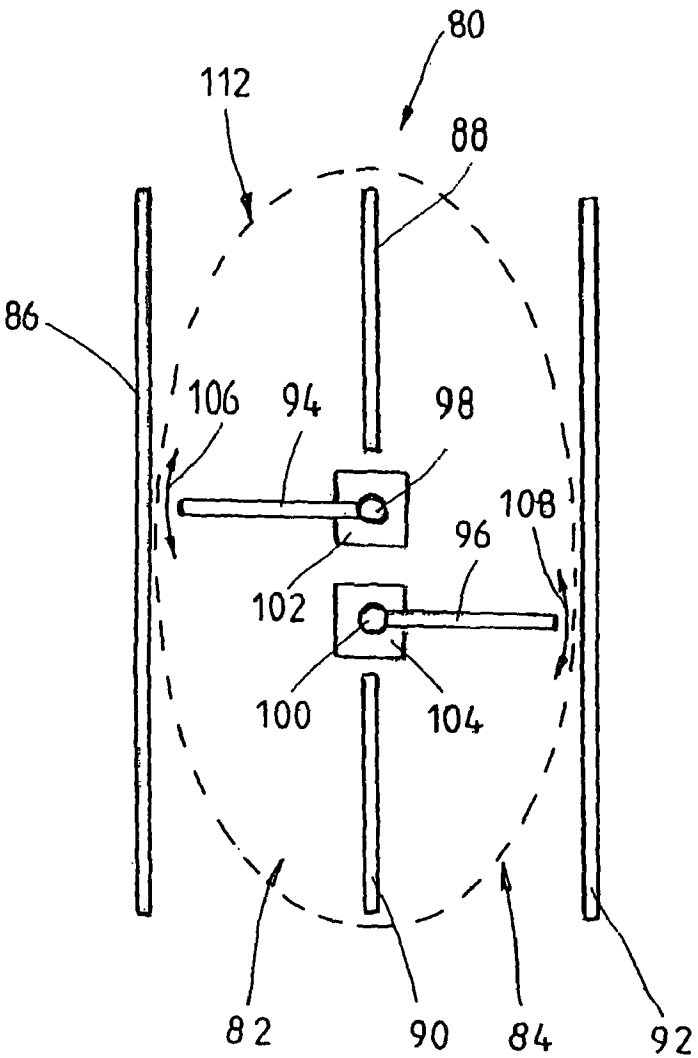
FIG. 3 is a schematic diagram showing a top view of another known passage barrier.
Figure 2:
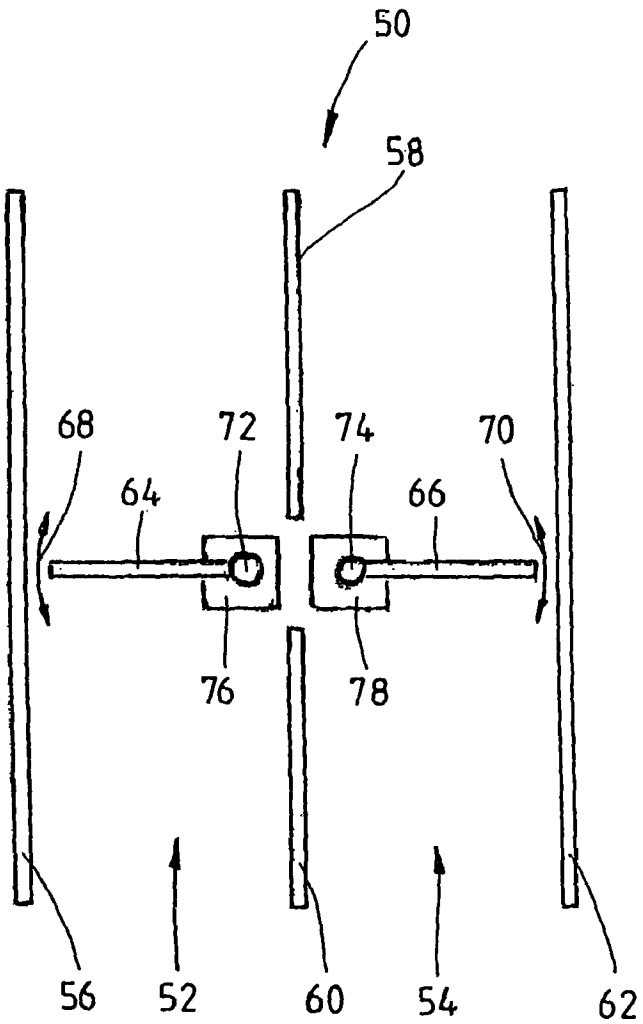
FIG. 2 is a schematic diagram showing a top view of a known passage barrier.
Figure 4:
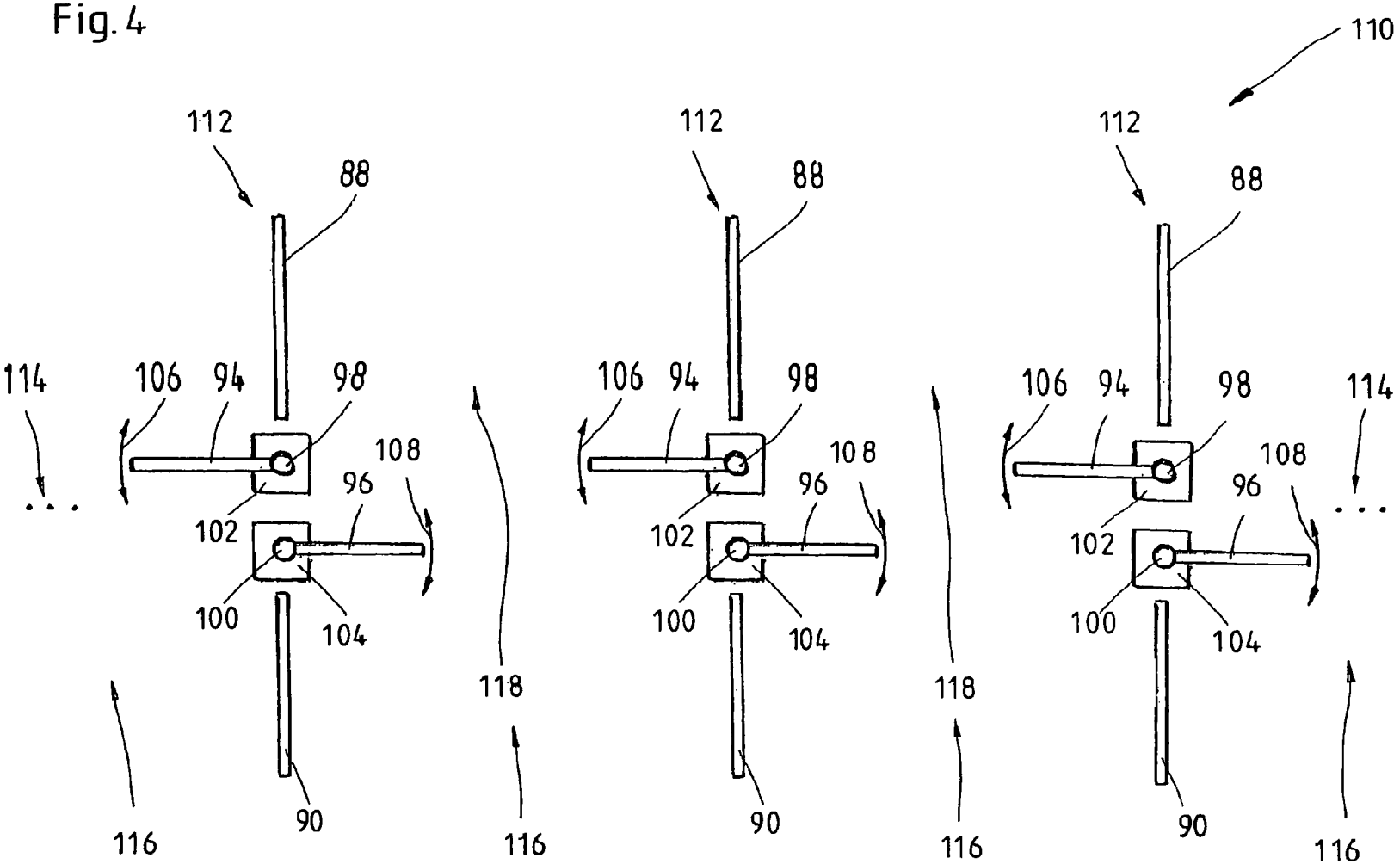
FIG. 4 is a schematic diagram showing a top view of yet another known passage barrier.

FIGS. 2, 3 and 4 were already described in the introductory section, which is why these Figs. will not be dealt with again in the following.

FIG. 1 shows a perspective view of an embodiment of a passage barrier 10 in accordance with the present invention. The passage barrier 10 comprises a base 12, from where an arrangement extends in a columnar manner vertically upwards, comprising in turn, seen from the bottom upwards, a first motor 14, a first shaft 16 which can be driven by the first motor, a bearing 18, a second shaft 20, and a second motor 22 for driving the second shaft 20. The free ends of the first shaft 16 and the second shaft 20 pointing toward each other are accommodated in bearing 18, such that they can be driven independent of each other by the respective motors 14 and 22.

The passage barrier 10 further comprises two wing-shaped barrier elements 24 and 26, which serve for optional blocking or opening two separate passage areas 28 and 30, which are separated by partition walls 32 and 34. The partition walls 32 and 34 are firmly arranged on base 12 in its longitudinal direction, whereby the arrangement consisting of the two motors 14 and 26, the two shafts 16 and 20, and the bearing 18 is provided between the two partition walls 32 and 34. For further stabilisation, the partition walls 32 and 34 can furthermore be firmly connected with the bearing 18 and/or with at least one more holding element formed as a movable bearing which, however, is not shown in the drawing.

Barrier element 24 is retained on the first shaft 16 by holding elements 36 and 38, which are formed as fixed bearings, so that in case of a rotary motion of the first shaft 16, barrier element 24 is swivelled together with the latter. Furthermore, the first barrier element 24 is retained on the second shaft 20 by a further holding element 40 which is formed as a movable bearing, so that a revolution of the second shaft 20 does not influence the first barrier element 24. Thus, holding element 40 serves only as an additional support for the first barrier element 24.

The second barrier element 26 is retained on the second shaft by holding elements 42 and 44, which are formed as fixed bearings, so that the second barrier element 26 will follow a rotational motion of the second shaft 20. In addition, the second barrier element is connected with the first shaft 16 by a further holding element 46, which is formed as a movable bearing, so that a rotary motion of the first shaft 16 does not influence the second barrier element. Holding element 46 therefore also serves only as an additional supporting element for stable positioning of the second barrier element 26.

Now, if the first shaft 16 is driven by the first motor 14, the first barrier element 24 performs a swivel motion corresponding to the direction of rotation of the first shaft 16. For swivelling the second barrier element 26, however, the second shaft 20 is moved by the second motor 22. In this manner, the barrier elements 24 and 26 can be swivelled independent of each other.

Between the first motor 14 and the first shaft 16 as well as between the second motor 22 and the second shaft 20, gears may be provided in order to adjust the speeds of the shafts 16 and 20 and the torques transmitted by them. The motors 14 and 22 are preferably direct current motors, each of which a servo controller 23 is assigned to. Such a servo controller facilitates controlling the motors 14 and 22, and thereby the shafts 16 and 20.

The passage barrier 10 shown in the drawing is characterised in particular by the barrier elements swivelling independent of each other, and by the simple, stable and space-saving structure, which is achieved in particular by the aligned arrangement of the shafts 16 and 20. In comparison with the known passage barriers 50 and 80 shown in FIGS. 2*a* and 2*b*, a correspondingly smaller amount of space is required for passage barrier 10.

It should be clear that the embodiment of the passage barrier according to the invention described above is not restrictive. But rather, modifications and changes are possible without leaving the scope of protection of the present invention, which is defined by the enclosed claims.

What is claimed is:

1. A passage barrier comprising:

two adjacently arranged passage areas;

a first barrier element and a second barrier element, each of which serves for optional blocking or opening of one of the passage areas; and an arrangement comprising:

a first shaft and a second shaft which are mutually aligned in a columnar manner and axially separated from each other such that they can be driven independent from each other;

a first motor and a second motor, wherein the first shaft is driven by the first motor and the second shaft is driven by the second motor; and wherein the first shaft and the second shaft as well as the first motor and the second motor extend vertically upwards in a columnar manner;

wherein the first barrier element is retained on the first shaft so that in case of rotary motion of the first shaft the first barrier element is swivelled together with the first shaft, and wherein the second barrier element is retained on the second shaft so that the second barrier element will follow the motion of the second shaft.

2. The passage barrier according to claim 1, wherein the shafts are separated from each other by at least one bearing.

3. The passage barrier according to claim 2, wherein at least one partition wall is firmly connected with the bearing and/or with at least one additional movable bearing.

4. The passage barrier according to claim 1, wherein each barrier element is retained on one of the first and the second shaft by at least one fixed bearing and on the other of the first and the second shaft by at least one movable bearing.

5. The passage barrier according to claim 1, wherein the motors are direct current motors.

6. The passage barrier according to claim 5, wherein one servo controller each is assigned to each of the direct current motors.

7. The passage barrier according to claim 1, wherein the shafts are designed as hollow shafts.

8. The passage barrier according to claim 1, wherein the mutually aligned shafts are coaxially aligned and are axially separated from each other by at least one bearing.

9. The passage barrier according to claim 8, wherein the first and second shafts each include a first end and a second end, the first ends coupled to the respective first and second motors and the second ends opposing each other and being directly retained in opposite sides of the at least one bearing, the at least one bearing being coaxially aligned with the first and second shafts.

10. The passage barrier according to claim 9, wherein the first and second shafts, first and second motors and the at least one bearing form a columnar structure, and wherein the first and second motors are positioned at respective opposite ends of the columnar structure.

11. The passage barrier according to claim 10, wherein each of the fixed and moveable bearings are directly mounted to an exterior of the respective first and second shafts.

12. The passage barrier according to claim 1, wherein the first bearing element is retained on the first shaft by at least one fixed bearing that moves with the first shaft and on the second shaft by at least one moveable bearing that can move relative to the second shaft; and wherein the second bearing element is retained on the second shaft by at least one other fixed bearing element that moves with the second shaft and on the first shaft by at least one other moveable bearing that can move relative to the first shaft.

* * * * *